US008281760B2

(12) United States Patent
Bolander et al.

(10) Patent No.: US 8,281,760 B2
(45) Date of Patent: Oct. 9, 2012

(54) CONTROL SYSTEM AND METHOD FOR PREVENTING ENGINE STALLS

(75) Inventors: Thomas E. Bolander, Flint, MI (US); Michael A. Kropinski, Troy, MI (US)

(73) Assignee: GM Global Technology Operations LLC

( * ) Notice: Subject to any disclaimer, the term of this patent is extended or adjusted under 35 U.S.C. 154(b) by 319 days.

(21) Appl. No.: 12/685,203

(22) Filed: Jan. 11, 2010

(65) Prior Publication Data

US 2011/0168117 A1 Jul. 14, 2011

(51) Int. Cl.
*F02N 11/08* (2006.01)
*F02N 99/00* (2010.01)

(52) U.S. Cl. ..... 123/179.3

(58) Field of Classification Search ..... 123/179.1, 123/179.3, 179.4
See application file for complete search history.

(56) References Cited

U.S. PATENT DOCUMENTS 3,638,774 A 2/1972 Burch et al.
4,126,214 A 11/1978 Kiss
4,721,083 A 1/1988 Hosaka
6,802,291 B2 * 10/2004 Ujifusa ..... 123/179.4

FOREIGN PATENT DOCUMENTS

JP 63297743 A * 12/1988

* cited by examiner

*Primary Examiner* — Stephen K Cronin
*Assistant Examiner* — Arnold Castro

(57) ABSTRACT

A control system for an engine including a starter may include a speed determination module that determines a first rotational speed of the engine during a run period contiguously following a period of starting the engine using the starter, and a speed control module that, when the first rotational speed falls below a predetermined speed greater than zero during the run period, selectively activates the starter to increase the first rotational speed. The speed control module may selectively activate the starter by selectively adjusting, based on the first rotational speed, a second rotational speed of a motor drive of the starter that supplies torque for cranking the engine and subsequently selectively engaging one of the motor drive and a first rotational member of the starter rotationally driven by the motor drive with a second rotational member of the engine. A related method is also provided.

20 Claims, 3 Drawing Sheets

CONTROL SYSTEM AND METHOD FOR PREVENTING ENGINE STALLS

FIELD

The present disclosure relates to control of an internal combustion engine, and more particularly to control systems and methods for preventing engine stalls.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Motor vehicles may include a powertrain that produces drive torque that is transmitted through a transmission at one or more gear ratios to a drivetrain that drives wheels of the vehicle. The powertrain may be a hybrid powertrain that includes an internal combustion engine and a hybrid drive system. During operation of the hybrid powertrain, drive torque may be supplied by the engine, the hybrid drive system, or a combination thereof.

The engine produces drive torque by combusting a mixture of air and fuel in cylinders of the engine. Air may be drawn into the engine through a throttle that controls the amount of air entering the engine. Fuel may be supplied by a fuel system that controls the amount of fuel supplied to the cylinders.

Engine control systems have been developed to control engine torque output. The engine control systems may control engine torque output to achieve a desired torque and/or a desired engine speed. The engine control systems may also control engine torque output to prevent engine stalls. Typically, such systems control engine torque output by varying one or more operating conditions of the engine. The operating conditions may include the amount of air entering the engine, the amount of fuel supplied to the engine, and/or engine spark timing. When preventing an engine stall, such systems may further control a load on the engine generated by one or more engine peripherals, such as an air-conditioning compressor.

SUMMARY

In one form, the present disclosure provides a control system for an engine including a starter for starting the engine by cranking that may include a speed determination module and a speed control module. The speed determination module may determine a first rotational speed of the engine during a run period contiguously following a period of starting the engine using the starter. The speed control module, when the first rotational speed falls below a predetermined first speed greater than zero during the run period, may selectively activate the starter to increase the first rotational speed. The speed control module may selectively activate the starter to increase the first rotational speed of the engine by selectively adjusting, based on the first rotational speed, a second rotational speed of a motor drive of the starter that supplies torque for cranking the engine and subsequently selectively engaging one of the motor drive and a first rotational member of the starter rotationally driven by the motor drive with a second rotational member of the engine. The predetermined first speed may be based on one of an engine temperature and a desired engine speed. The second rotational member may rotate with a crankshaft of the engine.

In one feature, the speed control module, when activating the starter to increase the first rotational speed of the engine, may move the first rotational member into engagement with the second rotational member after selectively adjusting the second rotational speed of the motor drive by activating an actuator for engaging and disengaging the first and second rotational members. In another feature, the first rotational member may continuously engage the second rotational member and the speed control module, when activating the starter to increase the first rotational speed of the engine, may engage the motor drive with the first rotational member after selectively adjusting the second rotational speed of the motor drive by activating an actuator of the starter for engaging and disengaging the motor drive and the first rotational member. In yet another feature, the speed control module may selectively activate the starter when an engine stalling condition has been detected.

In further features, the speed control module may activate the starter while the first rotational speed of the engine remains below a predetermined second speed greater than the predetermined first speed. In a related feature, the speed control module may disengage the one of the motor drive and the first rotational member from the second rotational member after a predetermined period.

In still further features, the speed control module may activate the starter while a difference between the first rotational speed of the engine and a desired engine speed is greater than a predetermined speed difference. In a related feature, the speed control module may disengage the one of the motor drive and the first rotational member from the second rotational member after a predetermined period.

In another form, the present disclosure provides a method for controlling an engine including a starter for starting the engine by cranking. The method may include determining a first rotational speed of the engine during a run period contiguously following a period of starting the engine using the starter, and selectively activating the starter to increase the first rotational speed when the first rotational speed falls below a predetermined first speed greater than zero. The selectively activating the starter to increase the rotational speed of the engine may include selectively adjusting, based on the first rotational speed, a second rotational speed of a motor drive of the starter that supplies torque for cranking the engine and subsequently selectively engaging one of the motor drive and a first rotational member rotationally driven by the motor drive with a second rotational member of the engine. The predetermined first speed may be based on one of an engine temperature and a desired engine speed. The second rotational member may rotate with a crankshaft of the engine.

In one feature, the selectively engaging may include moving the first rotational member into engagement with the second rotational member after the selectively adjusting the second rotational speed of the motor drive by activating an actuator of the starter for engaging and disengaging the first and second rotational members. In another feature, the first rotational member may continuously engage the second rotational member, and the selectively engaging may include engaging the motor drive with the first rotational member after the selectively adjusting the second rotational speed of the motor drive by activating an actuator of the starter for engaging and disengaging the motor drive and the first rotational member. In yet another feature, the method may further include selectively activating the starter when an engine stalling condition has been detected.

In further features, the selectively activating the starter may further include maintaining engagement between the one of the motor drive and the first rotational member and the second rotational member while the first rotational speed of the engine remains below a predetermined second speed greater than the predetermined first speed. In a related feature, the selectively engaging may further include disengaging the one of the motor drive and the first rotational member from the second rotational member after a predetermined period.

In still further features, the selectively activating may further include maintaining engagement between the one of the motor drive and the first rotational member and the second rotational member while a difference between the first rotational speed of the engine and a desired engine speed is greater than a predetermined speed difference. In a related feature, the selectively engaging may further include disengaging the one of the motor drive and the first rotational member from the second rotational member after a predetermined period.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
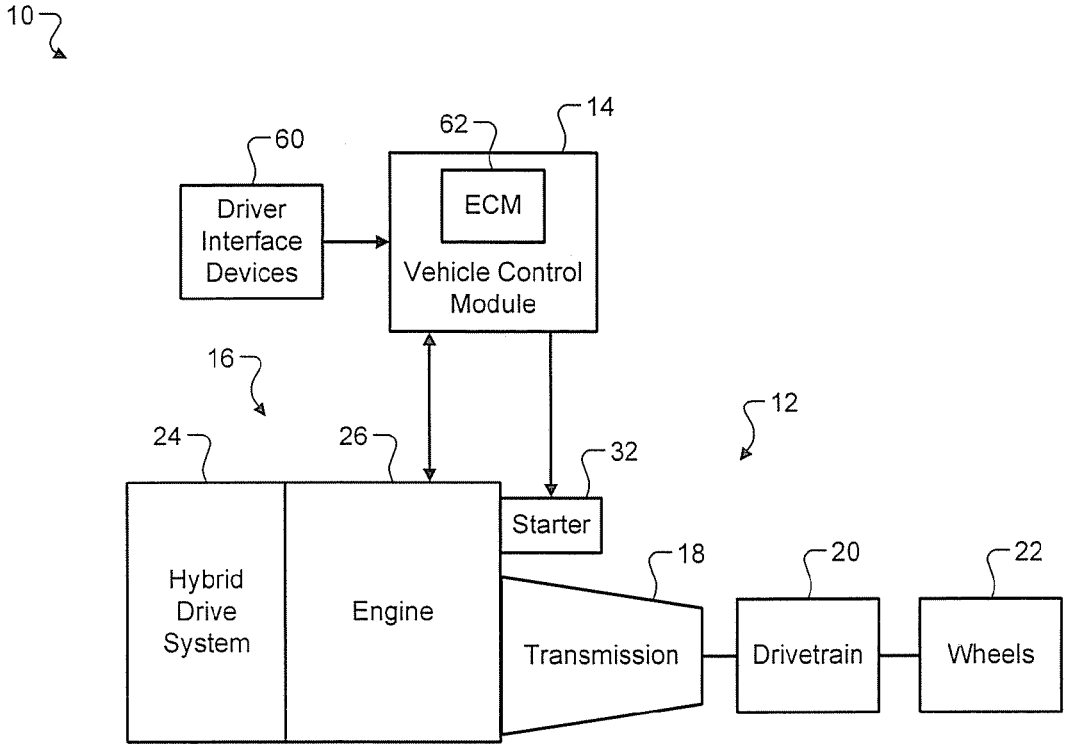
FIG. 1 is a functional block diagram illustrating an exemplary vehicle system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

Engines may inadvertently stall for both known and unknown reasons. Conventional engine control systems may attempt to prevent an engine stall by controlling engine torque output and/or a load on the engine. These attempts are not always successful. Accordingly, the present disclosure provides a system and method for preventing an impending engine stall by selectively operating a starter assembly of the engine at low engine speeds.

As discussed herein, the starter assembly is an assembly generally dedicated to cranking and thereby starting the engine. Additionally, the starter assembly is configured to engage the engine at engine speeds greater than zero and thereby supply torque to the engine while the engine is still running. The starter assembly is selectively activated to increase engine speed and thereby reduce a difference between a current engine speed and a desired engine speed. By supplying torque to the engine at low engine speeds, the starter assembly may be used to prevent an otherwise impending engine stall.

With particular reference to FIG. 1, an exemplary vehicle system 10 according to the present disclosure is shown. The vehicle system 10 includes a powertrain 12 controlled by a vehicle control module 14. The powertrain 12 includes a powerplant 16 that produces drive torque that is transmitted through a transmission 18 to a drivetrain 20 to drive wheels 22 of the vehicle. The powerplant 16 may be a hybrid powerplant that includes a hybrid drive system 24 coupled with an internal combustion engine 26. The powerplant 16 may be one of several hybrid configurations, including, but not limited to, a parallel hybrid configuration as discussed herein. As such, drive torque may be supplied by the hybrid drive system 24, the engine 26, or a combination thereof.

Figure 2:
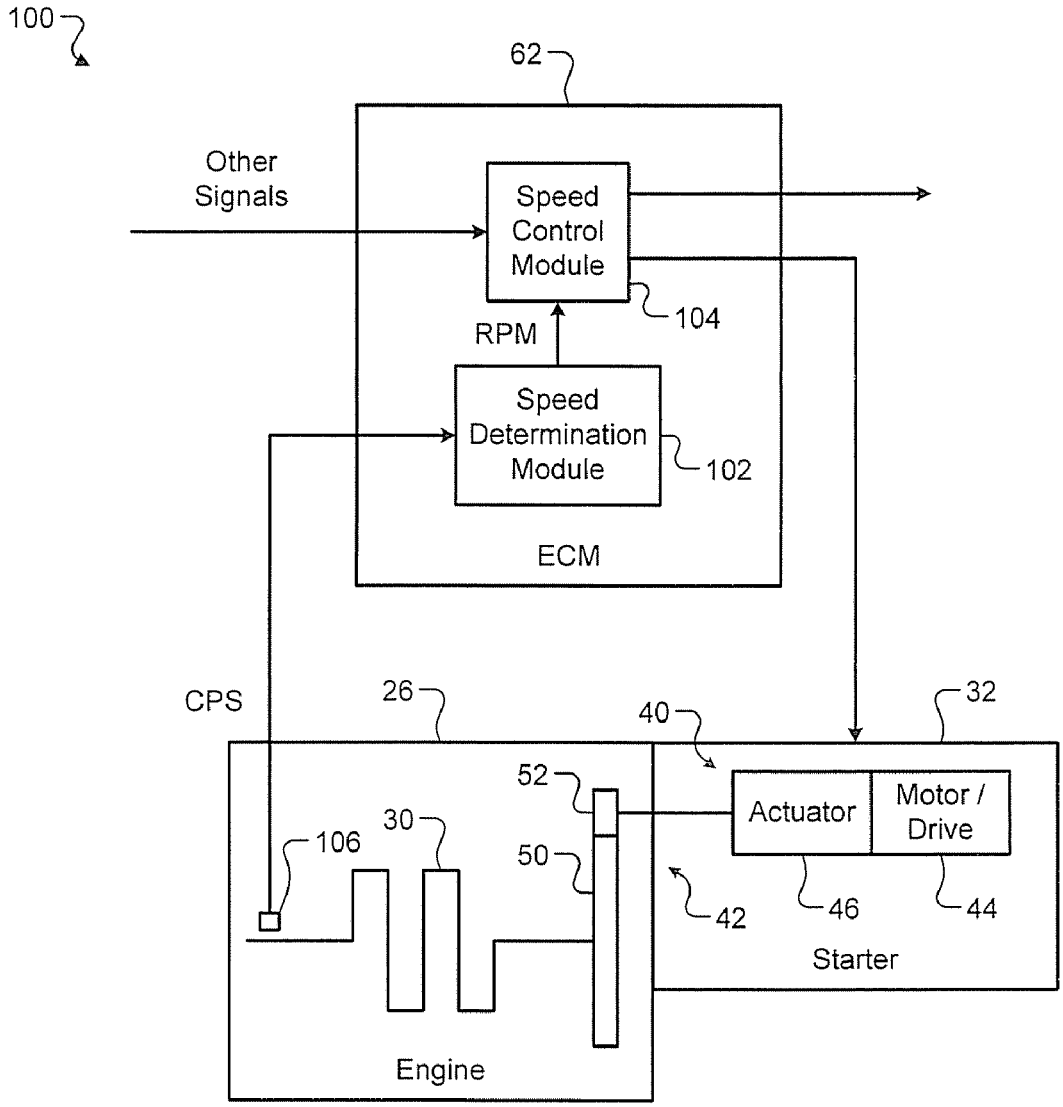
FIG. 2 is a functional block diagram illustrating an exemplary engine control system according to the present disclosure.

With particular reference to FIG. 2, the engine 26 may be one of several configurations including, but not limited to, the reciprocating type as discussed herein. The engine 26 produces drive torque by combusting a mixture of air and fuel in cylinders (not shown). Air may be drawn into the engine 26 through a throttle (not shown) that controls the amount of air entering the engine 26. Fuel may be supplied by a fuel system (not shown) that controls the amount of fuel supplied to the cylinders. The air-fuel mixture may be ignited by a spark ignition system (not shown) that supplies energy to the cylinders.

Pistons (not shown) may reciprocate within the cylinders in response to the combustion and transmit drive torque to a crankshaft 30. The crankshaft 30 rotates in response to the drive torque and may transmit the drive torque to the transmission 18.

The engine 26 includes a starter assembly 32 operable to supply torque to crank and thereby start the engine 26. One or more components of the starter assembly 32 may be disengaged from the engine 26 while the engine 26 is running. The starter assembly 32 is also of a type operable to re-engage the engine 26 at engine speeds greater than zero and thereby supply torque to the engine 26 while the engine 26 is running. According to the present disclosure and as discussed in further detail below, the starter assembly 32 may be selectively activated at low engine speeds to prevent an engine stall.

The starter assembly 32 may include a motor/actuator assembly 40 connected to the crankshaft 30 by a gear train 42. The motor/actuator assembly 40 may include a motor drive 44 and an actuator 46. The motor drive 44 may supply torque that is transmitted to the crankshaft 30 via the gear train 42. The actuator 46 may control whether the torque generated by the motor drive 44 is transmitted to the crankshaft 30. In various configurations, discussed in further detail below, the actuator 46 may be operable to selectively couple the motor drive 44 and one or more components of the gear train 42 with the crankshaft 30.

The gear train 42 may include a driven member 50 and a driving member 52. The driven member 50 may be fixed to rotate with the crankshaft 30 and may be rotatably driven by the driving member 52. The driving member 52 may be coupled to the motor/actuator assembly 40 and may be configured to be engaged and disengaged with the driven member 50 at engine speeds of zero and above.

When engaged with the driven member 50, the driving member 52 may transmit the torque supplied by the motor/actuator assembly 40 to the driven member 50. The actuator 46 may provide for the engagement and disengagement between the driven and driving members 50, 52. Alternately or additionally, engagement and disengagement may depend on engine speed and/or a relative speed between the driven and driving members 50, 52. In this case, the motor drive 44 may provide for the engagement and disengagement. In both cases, the motor/actuator assembly 40 may be activated to provide for the engagement of the driven and driving members 50, 52 and may be deactivated to provide for the disengagement of the driven and driving members 50, 52.

According to the present disclosure, the motor/actuator assembly 40 and the gear train 42 may be arranged in one of several configurations. In a ring and gear configuration, the driven member 50 may include a flywheel having a ring gear and the driving member 52 may include a drive pinion that meshes with the ring gear. In one arrangement, the drive pinion may be a retractable drive pinion that meshes with the ring gear when extended and is disengaged from the ring gear when retracted. In such an arrangement, the actuator 46 of the motor/actuator assembly 40 may control the extension and retraction of the drive pinion. In an alternate arrangement, the drive pinion may be in continuous engagement with the flywheel. In such an arrangement, the actuator 46 may be operable to selectively couple the motor drive 44 with the drive pinion.

In both arrangements, the motor/actuator assembly 40 may also be operable to synchronize the rotational speed of one of the driving member 52 and the motor drive 44 with the rotational speed of the driven member 50 at engine speeds greater than zero. The motor/actuator assembly 40 may include an overrunning-clutch mechanism which permits the drive pinion to transmit torque in only one direction.

In a centrifugal clutch configuration, the driven member 50 and driving member 52 may be urged into and out of engagement by centrifugal forces generated through rotation of the driven member 50 and driving member 52. In such configurations, the motor/actuator assembly 40 may control the engagement and disengagement by controlling the rotational speed of the driving member 52. For example, the actuator 46 may selectively engage the motor drive 44 with the driving member 52 and the motor drive 44 may control the rotational speed of the driving member 52.

Referring again to FIG. 1, the vehicle control module 14 controls operation of various components of the powertrain 12 including, but not limited to, the powerplant 16 and the transmission 18. The vehicle control module 14 may control the operation based on inputs received from various sensors (not shown). The vehicle control module 14 may control the drive torque produced by the powerplant 16 based on one or more driver interface devices 60, such as an accelerator pedal (not shown). The vehicle control module 14 may include an engine control module (ECM) 62 that controls operation of the engine 26.

The ECM 62 may control the engine 26 to produce a desired drive torque during periods of vehicle acceleration and/or cruising. The ECM 62 may also control the engine 26 to operate at a desired engine speed. As one example, the ECM 62 may control the engine 26 to operate at a desired idle speed during periods when the throttle is closed and the vehicle is operated at low speeds or has come to a stop. The desired idle speed may vary and may be a function of the desired drive torque, vehicle speed, and engine temperature, for example.

According to the present disclosure, the ECM 62 controls operation of the engine 26, including the starter assembly 32, to increase engine speed and thereby reduce a difference between a current engine speed and the desired engine speed. In particular, the ECM 62 selectively activates the starter assembly 32 at low engine speeds to supply torque to the engine 26 and thereby avoid an impending engine stall.

Referring again to FIG. 2, an exemplary implementation of the ECM 62 in an exemplary engine control system 100 for the engine 26 is shown. The ECM 62 may include a speed determination module 102 and a speed control module 104. The speed determination module 102 determines a rotational speed (RPM) of the engine 26. The speed determination module 102 may determine the engine RPM based on a signal generated by a crankshaft position sensor 106 that senses rotation of the crankshaft 30. The crankshaft position sensor 106 may generate a crankshaft position sensor (CPS) signal in response to rotation of the crankshaft 30.

The speed control module 104 receives the engine RPM and controls operation of the engine 26 to reduce a difference between a current engine RPM and a desired engine RPM. To this end, the speed control module 104 may control engine torque output to reduce the difference. When the current engine RPM is too low and/or an impending stall is detected, the speed control module 104 selectively activates the starter assembly 32 to supply torque to the engine 26 and thereby increase the engine RPM.

More specifically, the speed control module 104 may activate the starter assembly 32 when the current engine RPM falls below a predetermined speed. Alternately or additionally, the speed control module 104 may activate the starter assembly 32 when the current engine RPM is less than the desired engine RPM and a difference between the current engine RPM and the desired engine RPM is greater than a predetermined speed difference. The predetermined speed and the predetermined speed difference may vary and may be a function of one or more engine operating conditions such as, but not limited to, engine temperature and the desired engine RPM.

When activating the starter assembly 32, the speed control module 104 may adjust a rotational speed of the driving member 52 and a rotational speed of the motor drive 44 by selectively activating the motor drive 44 and the actuator 46. The speed control module 104 may control power supplied to the motor drive 44 and the actuator 46. By adjusting the rotational speeds of the driving member 52 and the motor drive 44, the speed control module 104 may control differences between the engine RPM and the rotational speeds of the driving member 52 and the motor drive 44.

The speed control module 104 may control the differences in rotational speeds to synchronize the rotational speeds of the driving member 52 and the motor drive 44 with the rotational speed of the driven member 50. In this manner, the speed control module 104 may provide for the smooth engagement of the driving member 52 with the driven member 50 in configurations, such as the retractable pinion and the centrifugal clutch configurations discussed above. The speed control module 104 may also control the differences in rotational speed to synchronize the rotational speed of the motor drive 44 with the driving member 52. In this manner, the speed control module 104 may provide for the smooth engagement of the motor drive 44 with the driving member 52 in configurations where the driving member 52 and the driven member 50 are continuously engaged.

The speed control module 104 may continue to activate the starter assembly 32 to supply torque until the current engine RPM is greater than a predetermined running speed. Alternately or additionally, the speed control module 104 may continue to activate the starter assembly 32 to supply torque until the difference between the current engine RPM and the desired engine RPM is less than the predetermined speed difference. The speed control module 104 may discontinue operation of the starter assembly 32 after a predetermined period.

While activating the starter assembly 32 to supply torque to the engine 26, the speed control module 104 may selectively adjust one or more engine operating conditions, such as spark timing, air intake, and fueling. The speed control module 104 may also control the operation of one or more peripheral engine devices to reduce the load on the engine 26. As such, it should be understood that the speed control module 104 may activate the starter assembly 32 in parallel with other control measures for increasing engine speed.

Figure 3:
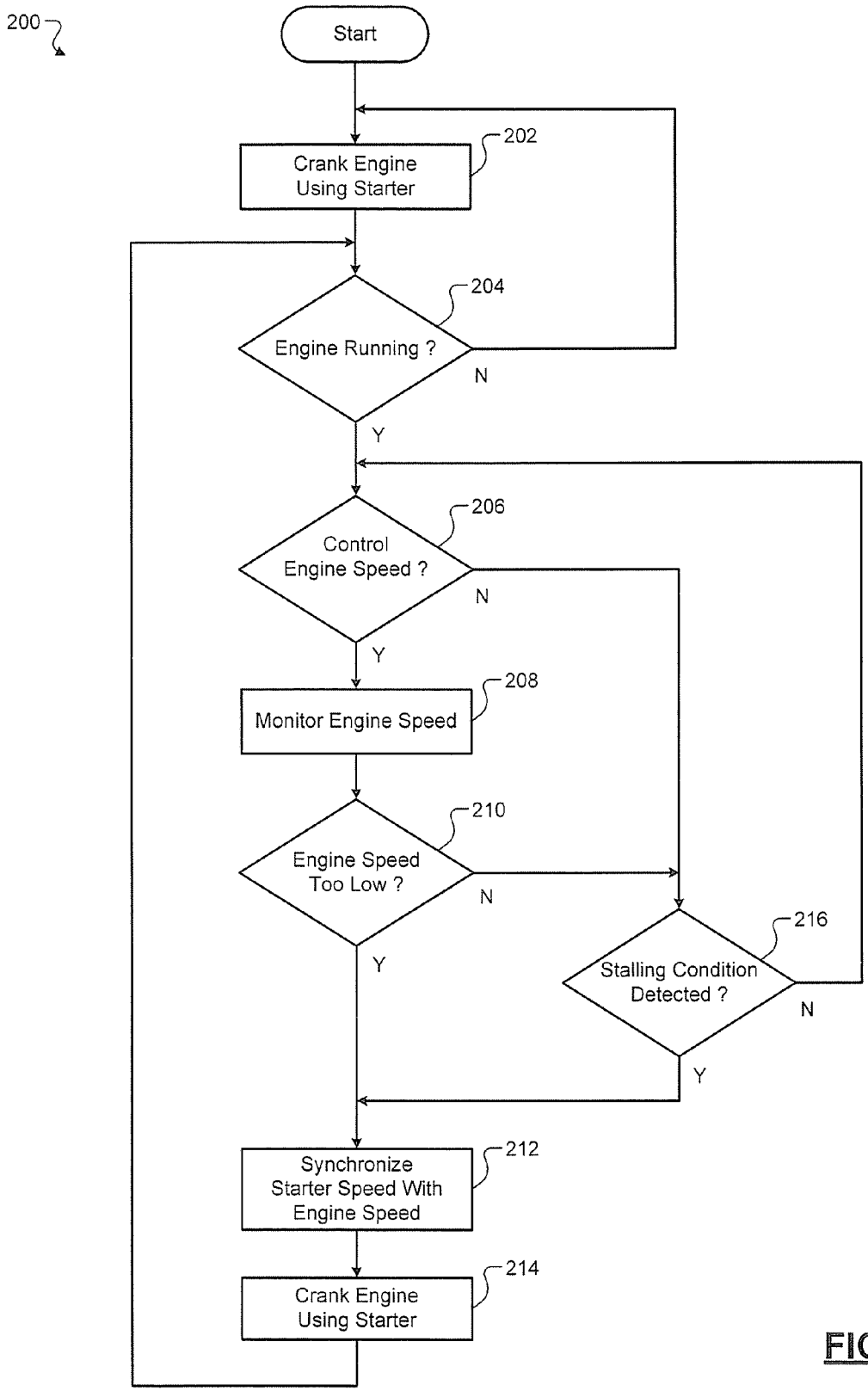
FIG. 3 is a flow diagram illustrating an exemplary method for controlling an engine according to the present disclosure.

With particular reference to FIG. 3, an exemplary method 200 for controlling the engine 26 and, more particularly the starter assembly 32 to prevent an engine stall is shown. The method 200 may be implemented in one or more modules of the engine system 100, such as the ECM 62, discussed above. For simplicity, the method 200 will be described with reference to the various components of the engine system 100.

Control under the method 200 begins in step 202 where the ECM 62 activates the starter assembly 32 to crank and thereby start the engine 26. The ECM 62 may activate the starter assembly 32 in response to a request to start the engine 26. During activation of the starter assembly 32, the starter assembly 32 may engage the engine 26 and begin to supply torque to the engine 26 that increases engine speed. The ECM 62 may continue to activate the starter assembly 32 until the engine RPM increases above a predetermined engine run speed. The predetermined engine run speed may correspond to an engine RPM above which the engine 26 may continue to operate (i.e., run) on its own at startup without the continued assistance of the starter assembly 32. The predetermined engine run speed may be a function of one or more engine operating conditions such as, but not limited to, engine temperature.

Control continues in step 204 where the ECM 62 determines whether the engine 26 is running. If the ECM 62 determines the engine 26 is running, then control proceeds in step 206, otherwise control returns to step 202 as shown. The ECM 62 may determine whether the engine 26 is running by comparing the current engine RPM and the predetermined engine run speed. For example, control may determine the engine 26 is running when the current engine RPM is greater than the predetermined engine run speed and the engine RPM is increasing.

In step 206, the ECM 62 determines whether engine speed control is desired. If engine speed control is desired, then control proceeds in steps 208-214 as shown, otherwise control proceeds in step 216. The ECM 62 may determine that engine speed control is desired during periods when the throttle is closed and the vehicle is operated at low speeds or has come to a stop.

In step 208, the ECM 62 monitors the current engine RPM. Next in step 210, the ECM 62 determines whether the current engine RPM is too low. If the current engine RPM is too low, control proceeds in step 212, otherwise control continues in step 216. The ECM 62 may determine the current engine RPM is too low when the current engine RPM falls below the predetermined speed. Alternatively or additionally, the ECM 62 may determine the current engine RPM is too low when the current engine RPM is less than the desired engine RPM and the difference between the current engine RPM and the desired engine RPM is greater than the predetermined speed difference. The predetermined speed and the predetermined speed difference may vary and may be a function of one or more engine operating conditions such as, but not limited to, engine temperature and the desired engine RPM.

In step 212, the ECM 62 synchronizes a rotational speed of the starter assembly 32 with the rotational speed of the engine 26 (i.e., current engine RPM) by activating the motor drive 44. The ECM 62 may synchronize a rotational speed of the motor drive 44 with a rotational speed of the driven member 50 that rotates with the engine 26. The ECM 62 may supply power that increases the rotational speed of the motor drive 44 such that a first difference between the rotational speed of the motor drive 44 and the rotational speed of the driven member 50 is less than a first predetermined speed difference. In configurations where the driving member 52 continuously engages the driven member 50, the ECM 62 may increase the rotational speed of the motor drive 44 such that a second difference between the rotational speed of the motor drive 44 and a rotational speed of the driving member 52 is less than a second predetermined speed difference.

In step 214, the ECM 62 cranks the engine 26 by activating the starter assembly 32 to increase the rotational speed of the engine 26 and thereby reduce the difference between the current engine RPM and the desired engine RPM. The ECM 62 may engage the driving member 52 with the driven member 50 by activating the actuator 46 while the rotational speeds of the starter assembly 32 and the engine 26 are synchronized. Following engagement, the ECM 62 may continue to activate the motor drive 44 to supply torque to the engine 26. The ECM 62 may continue to activate the starter assembly 32 to supply torque until the current engine RPM is greater than the predetermined engine run speed and/or the difference between the current engine RPM and the desired engine RPM is less than the predetermined speed difference. The ECM 62 may discontinue operation of the starter assembly 32 after a predetermined period. From step 214, control returns in step 204 and may proceed as discussed above.

In step 216, the ECM 62 determines whether an engine stalling condition exists. If an engine stalling condition is detected, then control proceeds in steps 212-214 as described above, otherwise control returns in step 206 as shown. The ECM 62 may utilize conventional methods for detecting an engine stalling condition. According to some conventional methods, an engine stalling condition may be detected based on engine speed, engine speed variation, and operation of engine peripherals that generate engine load.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system for an engine including a starter for starting said engine by cranking, the control system comprising:

a speed determination module that determines a first rotational speed of said engine during a run period contiguously following a period of starting said engine using said starter; and a speed control module that, when said first rotational speed is less than a first predetermined speed during said run period, determines a difference between said first rotational speed and a second predetermined speed, wherein said first predetermined speed is greater than zero, and wherein said second predetermined speed is greater than said first predetermined speed, prevents said engine from stalling including selectively activating said starter when said difference is greater than a predetermined difference, activates said starter to increase said first rotational speed by selectively adjusting a second rotational speed of a motor drive of said starter, wherein said starter supplies torque for cranking said engine, and subsequent to said activating of said starter, selectively engages one of said motor drive and a first rotational member of said starter, wherein said first rotational member is rotationally driven by said motor drive and engages with a second rotational member of said engine.

2. The control system of claim 1 wherein said speed control module:

when activating said starter to increase said first rotational speed, moves said first rotational member into engagement with said second rotational member after selectively adjusting said second rotational speed;

adjusts said second rotational speed by activating an actuator of said starter; and said starter engages and disengages said first and second rotational members.

3. The control system of claim 1 wherein:

said first rotational member engages said second rotational member;

said speed control module, when activating said starter to increase said first rotational speed, engages said motor drive with said first rotational member;

said speed control module engages said motor drive after selectively adjusting said second rotational speed;

said speed control module adjusts said second rotational speed by activating an actuator of said starter; and said actuator engages and disengages said motor drive and said first rotational member.

4. The control system of claim 1 wherein said first predetermined speed is based on one of an engine temperature and a desired engine speed.

5. The control system of claim 1 wherein said speed control module disengages said one of said motor drive and said first rotational member from said second rotational member after a predetermined period.

6. The control system of claim 1 wherein said speed control module maintains said starter in an activated state until said difference is less than said predetermined difference.

7. The control system of claim 1 wherein said speed control module:

determines a third rotational speed of said first rotational member;

determines a second difference between said second rotational speed and said third rotational speed; and controls at least one of said second rotational speed of said motor drive and a speed of said first rotational member to adjust said second difference and synchronizes said second rotational speed and said third rotational speed.

8. The control system of claim 1 wherein said control module:

determines a third rotational speed of said first rotational member;

determines a second difference between said first rotational speed and said third rotational speed; and controls at least one of said first rotational speed of said engine and a speed of said first rotational member to adjust said second difference and synchronizes said first rotational speed and said third rotational speed.

9. The control system of claim 1 wherein:

said first rotational member engages with said second rotational member of said engine and with an actuator of said starter;

said second rotational member is rotating at said first rotational speed; and based on said first rotational speed and said second rotational speed, controls engagement between said first rotational member and said second rotational member via said actuator and said motor drive.

10. The control system of claim 9 wherein said speed control module controls said actuator to couple said motor drive with said first rotational member.

11. The control system of claim 1 wherein said speed control module synchronizes said first rotational speed and said second rotational speed while said starter is activated.

12. The control system of claim 1 wherein said speed control module:

controls an actuator of said starter to engage said motor drive with said first rotational member in turn engaging said first rotational member with said second rotational member of said engine; and controls said motor drive to adjust a speed of said first rotational member while engaging said motor drive to said first rotational member.

13. The control system of claim 1 wherein said speed control module adjusts spark, air intake and fuel of said engine and load on said engine from peripheral devices to further increase said first rotational speed of said engine while said engine is being cranked by said starter.

14. A method for controlling an engine including a starter for starting said engine by cranking, the method comprising:

determining a first rotational speed of said engine during a run period contiguously following a period of starting said engine using said starter; and when said first rotational speed falls below a first predetermined speed, determining a difference between said first rotational speed and a second predetermined speed, wherein said first predetermined speed is greater than zero, and wherein said second predetermined speed is greater than said first predetermined speed, preventing said engine from stalling including selectively activating said starter when said difference is greater than a predetermined difference, wherein said starter is activated to increase said first rotational Speed by selectively adjusting a second rotational speed of a motor drive of said starter, and wherein said starter supplies torque for cranking said engine, and subsequent to said activating of said starter, selectively engaging one of said motor drive and a first rotational member of said starter, wherein said first rotational member is rotationally driven by said motor drive and engages with a second rotational member of said engine.

15. The method of claim 14 wherein said selectively engaging includes moving said first rotational member into engagement with said second rotational member after said selectively adjusting said second rotational speed;

said adjusting of said second rotational speed comprises activating an actuator of said starter; and said starter engages and disengages said first and second rotational members.

16. The method of claim 14 wherein:

said first rotational member engages said second rotational member;

said selectively engaging includes engaging said motor drive with said first rotational member after said selectively adjusting said second rotational speed;

said adjusting of said second rotational speed comprises activating an actuator of said starter; and said actuator engaging and disengaging said motor drive and said first rotational member.

17. The method of claim 14 wherein said first predetermined speed is based on one of an engine temperature and a desired engine speed.

18. The method of claim 14 wherein:

said selectively activating further includes maintaining engagement between said motor drive and said first rotational member and between said first rotational member and said second rotational member while said first rotational speed remains less than said second predetermined speed, and said second predetermined speed is greater than said first predetermined speed.

19. The method of claim 18 further comprising disengaging said one of said motor drive and said first rotational member from said second rotational member after a predetermined period.

20. The method of claim 14 further comprising disengaging said one of said motor drive and said first rotational member from said second rotational member after a predetermined period.

* * * * *